US009037008B2

(12) United States Patent
Hase et al.

(10) Patent No.: US 9,037,008 B2
(45) Date of Patent: May 19, 2015

(54) FIXING DEVICE AND IMAGE FORMING APPARATUS INCLUDING SAME

(71) Applicants: Takamasa Hase, Shizuoka (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takeshi Uchitani, Kanagawa (JP); Hiromasa Takagi, Tokyo (JP); Naoki Iwaya, Tokyo (JP); Teppei Kawata, Kanagawa (JP); Takuya Seshita, Kanagawa (JP); Arinobu Yoshiura, Kanagawa (JP); Takahiro Imada, Kanagawa (JP); Hajime Gotoh, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP)

(72) Inventors: Takamasa Hase, Shizuoka (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP);

(Continued)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 13/744,883

(22) Filed: Jan. 18, 2013

(65) Prior Publication Data

US 2013/0202320 A1 Aug. 8, 2013

(30) Foreign Application Priority Data

Feb. 2, 2012 (JP) ..... 2012-020894

(51) Int. Cl.
*G03G 15/20* (2006.01)

(52) U.S. Cl.
CPC ..... *G03G 15/2078* (2013.01); *G03G 15/2039* (2013.01); *G03G 2215/2035* (2013.01)

(58) Field of Classification Search
CPC . G03G 15/20; G03G 15/2039; G03G 15/205; G03G 15/2064; G03G 15/2078
USPC ..... 399/33, 44, 67–70, 320–334
See application file for complete search history.

(56) References Cited

U.S. PATENT DOCUMENTS 7,177,560 B2 * 2/2007 Fujisawa ..... 399/44
7,702,250 B2 * 4/2010 Yoda ..... 399/88

(Continued)

FOREIGN PATENT DOCUMENTS

JP 4-276784 10/1992
JP 8-286556 11/1996

(Continued)

OTHER PUBLICATIONS

U.S. Appl. No. 13/557,841, filed Jul. 25, 2012, Toshihiko Shimokawa, et al.

*Primary Examiner* — Clayton E Laballe
*Assistant Examiner* — Ruifeng Pu
(74) *Attorney, Agent, or Firm* — Harness, Dickey & Pierce, P.L.C.

(57) ABSTRACT

A fixing device including a fixing member, an opposing member, a plurality of heat sources, and a voltage detector. The opposing member is disposed opposite the fixing member to contact the fixing member to form a nip portion at which an unfixed image on a recording medium is fixed. The plurality of heat sources heats the fixing member. The voltage detector detects an applied voltage of at least one of the plurality of heat sources. Upon detection of the applied voltage of the heat sources by the voltage detector, a voltage is applied to at least one of the heat sources.

15 Claims, 7 Drawing Sheets

(72) Inventors: Takeshi Uchitani, Kanagawa (JP); Hiromasa Takagi, Tokyo (JP); Naoki Iwaya, Tokyo (JP); Teppei Kawata, Kanagawa (JP); Takuya Seshita, Kanagawa (JP); Arinobu Yoshiura, Kanagawa (JP); Takahiro Imada, Kanagawa (JP); Hajime Gotoh, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Akira Suzuki, Tokyo (JP)

(56) References Cited

U.S. PATENT DOCUMENTS

| | | | | |
|---|---|---|---|---|
| 8,032,048 | B2 * | 10/2011 | Monde | 399/70 |
| 8,032,069 | B2 * | 10/2011 | Shin et al. | 399/329 |
| 2005/0139584 | A1 * | 6/2005 | Kishi et al. | 219/202 |
| 2005/0207775 | A1 * | 9/2005 | Yokono | 399/69 |
| 2006/0029411 | A1 | 2/2006 | Ishii et al. | |
| 2007/0212089 | A1 | 9/2007 | Seo et al. | |
| 2007/0242988 | A1 | 10/2007 | Seo et al. | |
| 2007/0274736 | A1 * | 11/2007 | Sato et al. | 399/88 |
| 2007/0280754 | A1 | 12/2007 | Ogawa et al. | |
| 2008/0025772 | A1 | 1/2008 | Seo et al. | |
| 2008/0025773 | A1 | 1/2008 | Ito et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237248 | A1 * | 9/2012 | Aoki | 399/88 |
| 2012/0237273 | A1 | 9/2012 | Yoshinaga et al. | |

FOREIGN PATENT DOCUMENTS

| | | |
|---|---|---|
| JP | 2002-174985 | 6/2002 |
| JP | 2008-065002 | 3/2008 |

* cited by examiner

FIXING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2012-020894, filed on Feb. 2, 2012, in the Japan Patent Office, the entire disclosure of which is hereby incorporated by reference herein.

BACKGROUND OF THE INVENTION

1. Field of the Invention

Exemplary aspects of the present disclosure generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In known image forming apparatuses, the unfixed toner image is heated while the record medium carrying the unfixed toner image is interposed between a fixing member and a pressing member, thereby melting and softening a developing agent in the unfixed toner image to fix the toner to the fixing member.

When heating the fixing member to a predetermined temperature by a heat source, if the desired temperature of the fixing member is achieved in a short period of time, even omitting a pre-heating process in a standby state does not have a large affect on the usability of a user, thereby allowing significant reduction in consumption energy. In view of the above, the fixing member employs parts having a low heat capacity such as a thin roller and a thin belt formed of a metal base member on which an elastic rubber layer is disposed. Further, in order to heat the fixing member quickly, an IH (induction heating) type heater with high heating efficiency is used, on top of a halogen heater, or the like.

A source voltage for a commercial power source may change on the user side. Furthermore, an input voltage from the commercial power source is not smaller than a rated voltage of the image forming apparatus. In such a case, when temperature control of a fixing section is performed on the same condition, power may be supplied excessively by the heat source, causing the temperature of the fixing member to rise excessively.

In view of the above, in one approach, a voltage applied to the heat source is detected, and based on the detection result, a duty cycle between a time during which power is applied to the heat source and a time during which power is not applied to the heat source per unit time is controlled in accordance with the detected voltage, to control power consumption.

Although a voltage can be detected at a position close to the commercial power source without application of a voltage to the heat source, power supply to the fixing device or the use of another electric device using the same power source may cause fluctuation in applied voltage to the fixing device. However, it is necessary to turn on the heat source for one to two seconds with a duty cycle of 100% in order to detect a more accurate voltage while power is applied to the fixing device. In a case in which a voltage larger than a rated voltage is applied to the heat source and the heat source is turned on with a duty cycle of 100%, the temperature of the fixing device may rise excessively. In particular, in the case of using a thin roller or belt for the fixing member, the temperature of the fixing member tends to rise easily, causing the temperature of the fixing member to rise beyond the acceptable range.

In view of the above, there is demand for a fixing device capable of accurately detecting an applied voltage to a heat source and also capable of preventing an excessive temperature rise of the fixing member, and an image forming apparatus including the fixing member.

SUMMARY OF THE INVENTION

In view of the foregoing, in an aspect of this disclosure, there is provided an improved fixing device including a fixing member, an opposing member, a plurality of heat sources, and a voltage detector. The opposing member is disposed opposite the fixing member to contact the fixing member to form a nip portion at which an unfixed image on a recording medium is fixed. The plurality of heat sources heats the fixing member. The voltage detector detects an applied voltage of at least one of the plurality of heat sources. Upon detection of the applied voltage of the heat sources by the voltage detector, a voltage is applied to at least one of the heat sources.

According to another aspect, an image forming apparatus includes a fixing device including a fixing member, an opposing member, a plurality of heat sources, and a voltage detector. The opposing member is disposed opposite the fixing member to contact the fixing member to form a nip portion at which an unfixed image on a recording medium is fixed. The plurality of heat sources heats the fixing member. The voltage detector detects an applied voltage of at least one of the plurality of heat sources. Upon detection of the applied voltage of the heat sources by the voltage detector, a voltage is applied to at least one of the heat sources.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
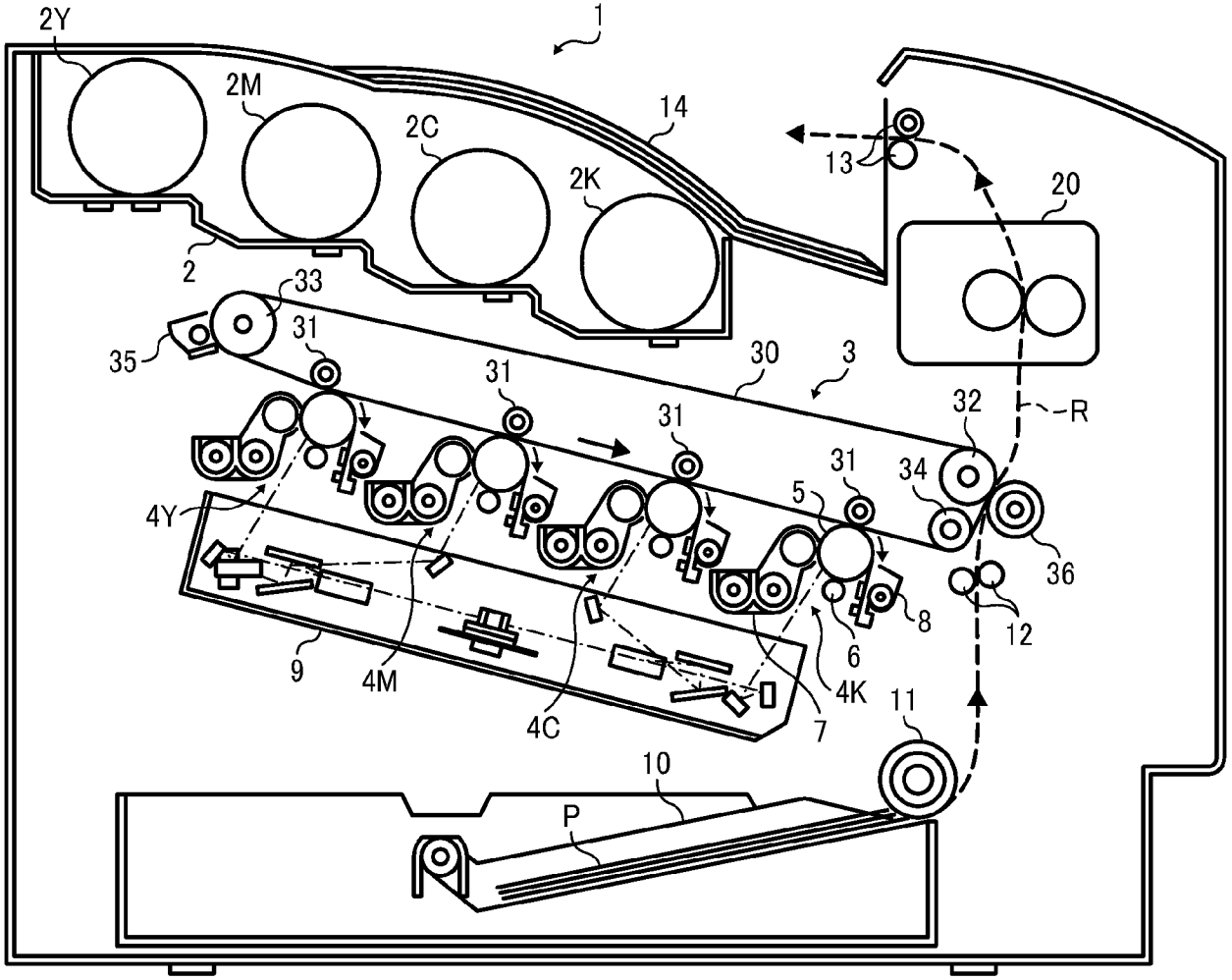
FIG. 1 is a schematic diagram illustrating an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

An image forming apparatus 1 illustrated in FIG. 1 is an example of a color laser printer, and at the middle of the main body, four image forming units 4Y, 4M, 4C, 4K are provided. The respective image forming units 4Y, 4M, 4C, 4K all have the same configuration as all the others, except for housing developers of different colors: yellow (Y); magenta (M); cyan (C); and black (K), which correspond to color separation components of a color image. It is to be noted that reference characters Y, C, M, and K denote the colors yellow, cyan, magenta, and black, respectively. To simplify the description, the reference characters Y, M, C, and K indicating colors are omitted herein unless otherwise specified.

More specifically, each of the image forming units 4Y, 4M, 4C, 4K is provided with a drum-shaped photoreceptor 5 as a latent image bearing member, a charging unit 6 that charges the surface of the photoreceptor 5, a development unit 7 that supplies toner to the surface of the photoreceptor 5, a cleaning unit 8 that cleans the surface of the photoreceptor 5, and the like. It is to be noted that in FIG. 1, the suffix indicating the color is provided only to the photoreceptor 5, the charging unit 6, the development unit 7 and the cleaning unit 8 included in the black image forming unit 4K, and the suffixes indicating colors are omitted for the other image forming units 4Y, 4M, and 4C.

Below the image forming units 4Y, 4M, 4C, and 4K, an exposure unit 9 that exposes the surface of the photoreceptor 5 is disposed. The exposure unit 9 has a light source, a polygon mirror, an f-O lens, a reflective minor, and the like, and illuminate the surface of each photoreceptor 5 with laser light based on image data.

Above the image forming units 4Y, 4M, 4C, and 4K, a transfer unit 3 is disposed. The transfer unit 3 includes an intermediate transfer belt 30 as a transfer body, four primary transfer rollers 31 as a primary transfer mechanism, a secondary transfer roller 36 as a secondary transfer mechanism, a secondary transfer backup roller 32, a cleaning backup roller 33, a tension roller 34, a belt cleaning unit 35.

The intermediate transfer belt 30 is a belt formed into a loop and entrained about the secondary transfer backup roller 32, the cleaning backup roller 33 and the tension roller 34. Herein, by the secondary transfer backup roller 32 being rotationally driven, the intermediate transfer belt 30 moves or rotates in a direction indicated by an arrow in FIG. 1.

The intermediate transfer belt 30 is interposed between each of the four primary transfer rollers 31 nips and the photoreceptors 5, thereby forming a primary transfer nip therebetween. Further, each primary transfer roller 31 is connected with a power source, not illustrated, and a predetermined direct current (DC) voltage and/or an alternating current voltage (AC) are supplied to each primary transfer roller 31.

The intermediate transfer belt 30 is interposed between the secondary transfer roller 36 and the secondary transfer backup roller 32, thereby forming a secondary transfer nip therebetween. Moreover, similar to the primary transfer roller 31, the secondary transfer roller 36 is also connected with a power source, not illustrated, and a predetermined direct current voltage (DC) and/or an alternating current (AC) voltage are applied to the secondary transfer roller 36.

The belt cleaning unit 35 has a cleaning brush and a cleaning blade which are disposed so as to be in contact with the intermediate transfer belt 30. A waste toner transferring tube, not illustrated, extending from the belt cleaning unit 35 is connected to an inlet section of the waste toner housing, not illustrated.

In the upper part of the main body, a bottle housing unit 2 is provided, and four toner bottles 2Y, 2M, 2C, and 2K that house supplemental toner are removably mounted in the bottle housing unit 2. A supply path, not illustrated, is provided between each of the toner bottles 2Y, 2M, 2C, and 2K and each of the development units 7, and toner is supplied from each of the toner bottles 2Y, 2M, 2C, and 2K to each of the respective development units 7 via the supply path.

Meanwhile, in the lower part of the main body, there are provided a paper feeding tray 10 that houses paper P as the record medium, a paper feeding roller 11 that takes the paper P out of the paper feeding tray 10, and the like. According to the present illustrative embodiment, other than ordinary paper, the record medium includes cardboard, a postcard, an envelope, thin paper, applied paper (coated paper, art paper, etc.), tracing paper, an OHP sheet, and the like. Although not illustrated, a manual paper feed system may be provided.

Inside the main body, a sheet delivery path R is disposed to deliver the paper P from the paper feeding tray 10 to pass through the secondary transfer nip and ejects the paper to the outside of the apparatus. Upstream from the secondary transfer roller 36 in the sheet delivery path R in a paper delivery direction, there is provided a pair of registration rollers 12 as a delivery mechanism to deliver the paper P to the secondary transfer nip.

Further, upstream from the secondary transfer roller 36 in the paper delivery direction, there is provided a fixing unit 20 for fixing an unfixed image transferred to the paper P. Moreover, downstream from the fixing unit 20 in the sheet delivery path R in the paper delivery direction, there is provided a pair of sheet output rollers 13 for ejecting the paper to the outside of the image forming apparatus. Furthermore, on the top surface section of the main body, an output paper tray 14 for holding in stock the paper ejected to the outside of the image forming apparatus.

Next, with reference to FIG. 1, a basic operation of the image forming apparatus according to the present illustrative embodiment will be described. Upon start of an image forming operation, each photoreceptor 5 in each of the image forming units 4Y, 4M, 4C, and 4K is rotated by a driving unit, not illustrated, in a clockwise direction in FIG. 1, and the surface of each photoreceptor 5 is uniformly charged by the charging unit 6 to a predetermined polarity. The charged surface of each photoreceptor 5 is illuminated with laser light from the exposure unit 9, to form an electrostatic latent image on the surface of each photoreceptor 5. At this time, the image information exposed to each photoreceptor 5 includes image information decomposed into yellow, magenta, cyan and black color information. In such a manner, toner is supplied by each development unit 7 to the electrostatic latent image formed on each photoreceptor 5, thereby making the electrostatic latent image apparent (visible) as a toner image.

Further, upon start of the image forming operation, the secondary transfer backup roller 32 is rotated in the counterclockwise direction in FIG. 1, to move the intermediate transfer belt 30 in the direction indicated by the arrow. Then, each primary transfer roller 31 is supplied with a constant-voltage controlled or constant-current control voltage having the polarity opposite that of the charged toner. Accordingly, a transfer electric field is formed in the primary transfer nip between each primary transfer roller 31 and each photoreceptor 5.

When a toner image of each color on the photoreceptor 5 arrives at the primary transfer nip in association with rotation of each photoreceptor 5, the toner images on each photoreceptor 5 are sequentially transferred onto the intermediate transfer belt 30 due to the transfer electric field formed in the primary transfer nip, such that they are superimposed one atop the other, thereby forming a composite toner image on the surface of the intermediate transfer belt 30. After transfer of the toner image, toner remaining on each photoreceptor 5 which was not transferred to the intermediate transfer belt 30 is removed by the cleaning unit 8. Charge on each surface of the photoreceptor 5 is then removed by a charge neutralizer, not illustrated, to initialize a surface potential.

In the lower part of the image forming apparatus, the paper feeding roller 11 starts to rotate, and the paper P is sent out from the paper feeding tray 10 to the sheet delivery path R. The paper P sent out to the sheet delivery path R is fed to the secondary transfer nip between the secondary transfer roller 36 and the secondary transfer backup roller 32 at an appropriate timing adjusted by the pair of registration rollers 12. At this time, the secondary transfer roller 36 has been supplied with a transfer voltage having the opposite polarity to the charge polarity of toner image on the intermediate transfer belt 30, thereby forming a transfer electric field in the secondary transfer nip.

When the toner image on the intermediate transfer belt 30 then reaches the secondary transfer nip as the intermediate transfer belt 30 rotates, the composite toner image on the intermediate transfer belt 30 is transferred onto the paper P by the transfer electric field formed in the secondary transfer nip. Further, at this time, the residual toner on the intermediate transfer belt 30 which has not been transferred to the paper P is removed by the belt cleaning unit 35, and the removed toner is delivered and collected to the waste toner housing, not illustrated.

The paper P is then delivered to the fixing unit 20, and toner image on the paper P is fixed to the paper P by the fixing unit 20. The paper P is then output outside of the apparatus by the sheet output roller 13 and stacked on the output paper tray 14.

The above description pertains to an image forming operation for a color image. It is also possible to form a monochrome image using any one of the four image forming units 4Y, 4M, 4C, and 4K, or to form an image of two or three colors by using two or three image forming units.

Figure 2:
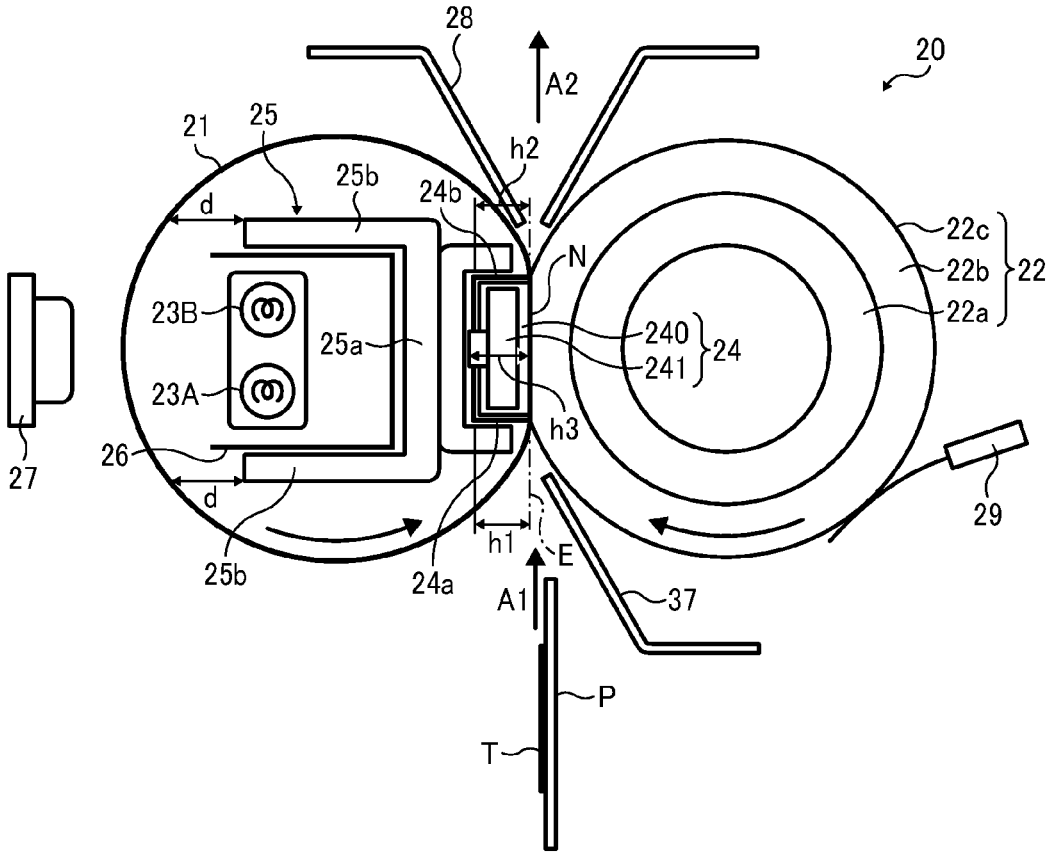
FIG. 2 is a sectional side view of a fixing device employed in the image forming apparatus of FIG. 1.
Figure 3:
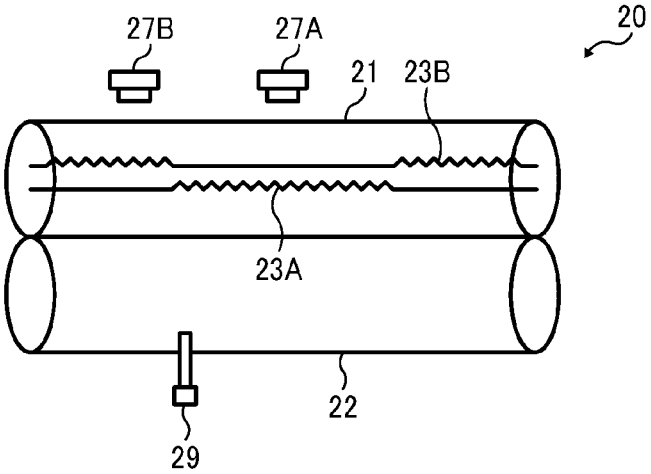
FIG. 3 is a plan view schematically illustrating the fixing device.

Next, with reference to FIGS. 2 through 4 (4A, 4B, and 4C), a description is provided of the fixing unit 20 according to an illustrative embodiment of the present invention.

Figure 4A:
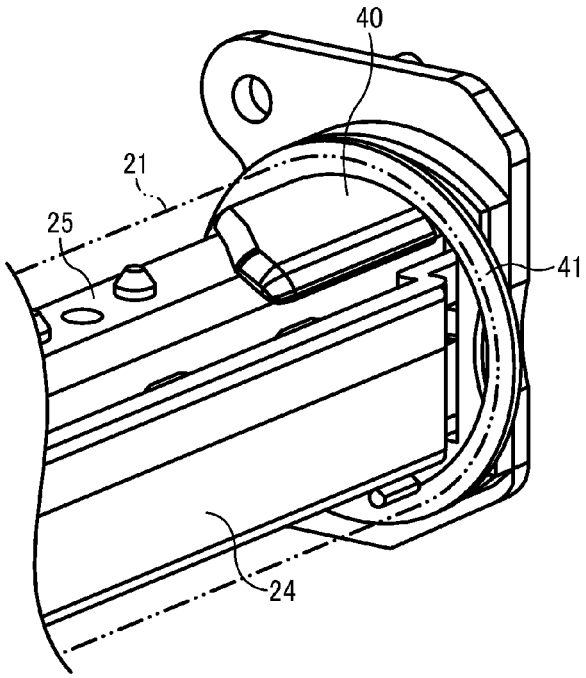
FIG. 4A is a perspective view schematically illustrating an end portion of a fixing belt.
Figure 4B:
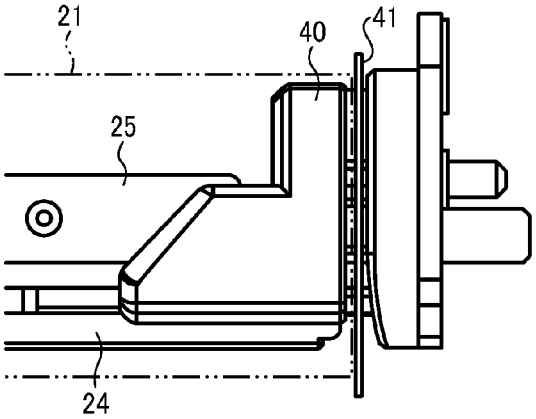
FIG. 4B is a plan view schematically illustrating the end portion of the fixing belt.
Figure 4C:
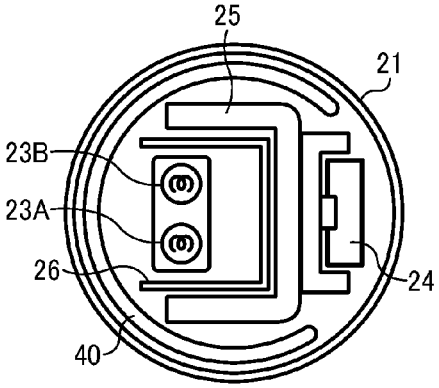
FIG. 4C is a side view schematically illustrating the fixing belt as viewed from a direction of a rotation axis of the fixing belt.

FIG. 2 is a sectional side view schematically illustrating the fixing device 20. FIG. 3 is a schematic plan view thereof. FIG. 4A is a perspective view of an end portion of a fixing belt 21, FIG. 4B is a plan view of the end portion of a fixing belt 21, and FIG. 4C is a side view seen from a direction of a rotation axis of the fixing belt 21.

As illustrated in FIG. 2, the fixing unit 20 includes a fixing belt 21 serving as a fixing member; a pressing roller 22 as an opposing member disposed opposite the fixing belt 21; two halogen heaters 23A and 23B serving as a heat source that heats the fixing belt 21; a nip forming member 24 disposed inside the fixing belt 21; a stay 25 serving as a support member for supporting the nip forming member 24; a reflective member 26 that reflects light emitted from each of the halogen heaters 23A and 23B onto the fixing belt 21; two thermopiles 27A and 27B (shown in FIG. 3) serving as a temperature detecting mechanism for detecting a temperature of the fixing belt 21; a thermistor 29 serving as a temperature detector for detecting a temperature of the pressing roller 22; a separation member 28 for separating paper from the fixing belt 21; and a pressure mechanism, not illustrated, for pressing the pressing roller 22 towards the fixing belt 21, and so forth.

The fixing belt 21 is formed of a thin, flexible endless-shaped belt member (including a film). More specifically, the fixing belt 21 includes a base member constituting an inner peripheral side and made of a metal material such as nickel or SUS or a resin material such as polyimide (PI), and a separating layer constituting an outer peripheral side formed of tetrafluoroetylene-perfluoroalkylvinylether copolymer (PFA) or polytetrafluoroethylene (PTFE). Further, an elastic layer made of a rubber material such as silicone rubber, foaming silicone rubber or fluoro-rubber may be provided between the base member and the separating layer.

The pressing roller 22 is formed of a cored bar 22*a*, an elastic layer 22*b* made of foam silicone rubber, silicone rubber or fluoro-rubber which is provided on the surface of the cored bar 22*a*, and a separating layer 22*c* made of PFA or PTFE which is provided on the surface of the elastic layer 22. The pressing roller 22 is pressed against the fixing belt 21 side by a pressing mechanism, not illustrated, and is in contact with the nip forming member 24 via the fixing belt 21. At a place where the pressing roller 22 and the fixing belt 21 press against each other, the elastic layer 22*b* of the pressing roller 22 is pressed to form a nip portion N with a predetermined width. Further, the pressing roller 22 is rotated by a drive source such as motor disposed in the main body. When the pressing roller 22 is rotated, the driving force is transmitted to the fixing belt 21 in the nip portion N, causing the fixing belt 21 to rotate.

In the present illustrative embodiment, the pressing roller 22 is a hollow roller, but it may be a solid roller. Further, a heat source such as a halogen heater may be disposed inside the pressing roller 22. Moreover, in a case in which the pressing roller 22 does not include the elastic layer 22*b*, a heat capacity becomes smaller to improve fixing properties, but when unfixed toner is pressed against paper, microasperity on the belt surface may show up in a resulting output image and uneven brightness may occur in a solid part of the image. To address this difficulty, it is desirable that an elastic layer have a thickness of not smaller than 100 μm. The elastic layer with a thickness of not smaller than 100 μm absorbs microasperity of the belt due to elastic transformation of the elastic layer, so as to avoid occurrence of uneven brightness. The elastic layer 22*b* may be solid rubber, but sponge rubber may be used if the pressing roller 22 does not have the heat source inside thereof. The sponge rubber is more preferred since it enhances thermal insulation properties to maintain the temperature of the fixing belt 21. Further, according to the present illustrative embodiment, the fixing member and the opposite member press against each other, but may simply contact one another without pressing each other.

Each end of the halogen heaters 23A and 23B is fixed to a side plate (not illustrated) of the fixing unit 20. In FIG. 3, when the lower-side halogen heater 23A is referred to as a first halogen heater and the upper-side halogen heater 23B is referred to as a second halogen heater for descriptive purposes, the position of a heat generating portion of the first halogen heater 23A is different from that of the second halogen heater 23B. More specifically, substantially the center of the first halogen heater 23A in a longitudinal direction includes a heat generating portion. The second halogen heater 23B includes a heat generating portion substantially at both ends thereof in the longitudinal direction.

In the present illustrative embodiment, the length of the heat generating portion of the first halogen heater 23A is in a range of from approximately 200 mm to 220 mm in the center thereof in the longitudinal direction with the center taken as an axis of symmetry. The heat generating portion of the second halogen heater 23B is disposed outside the heat generating portion of the first halogen heater 23A, that is, outside the center portion in a range of from approximately 200 mm to 220 mm in the longitudinal direction with the center taken as an axis of symmetry, but disposed within a range of approximately 300 mm to 330 mm. While paper sizes used in this image forming apparatus include A3-portrait and A4-landscape and each has a paper-passage width of 297 mm, a light emission length in combination of the respective heat generating portions of the first halogen heater 23A and the second halogen heater 23B is from 300 mm to 330 mm, which means the total light emission length is longer than the paper-passage width. The length has been set so because in a typical halogen heater, the intensity of light emission decreases more toward the end thereof and hence the light emission length needs to be made longer than the paper-passage width in order to prevent the temperature from dropping at the end of a paper-passage region when the paper starts to pass through the nip.

Further, as illustrated in FIG. 3, out of the two thermopiles 27A and 27B, the first thermopile 27A is disposed substantially at the center of the fixing belt 21 in the axial direction, and the second thermopile 27B is disposed substantially at the end side of the fixing belt 21 in the axial direction. The first thermopile 27A is provided corresponding to the heat generating portion substantially at the center of the first halogen heater 23A and the second thermopile 27B is provided corresponding to the heat generating portion at the end of the halogen heater 23B.

A power source unit provided in the main body of the image forming apparatus controls output of the halogen heaters 23A and 23B to generate heat based on results of detection of the surface temperature of the fixing belt 21 detected by the thermopiles 27A and 27B. Such output control on the heaters 23A and 23B sets the temperature (fixing temperature) of the fixing belt 21 to a desired temperature. Further, as the heat source that heats the fixing belt 21, IH (induction heating), a resistive heating element, a carbon heater or the like may be used other than halogen heaters.

As illustrated in FIG. 2, the nip forming member 24 includes a base pad 241, and a sliding sheet (low friction sheet) 240 provided on the surface of the base pad 241. The base pad 241 is long continuously over the axial direction of the fixing belt 21 or the axial direction of the pressing roller 22*a*, and determines a shape of the nip portion N by receiving pressure from the pressing roller 22. Further, the base pad 241 is fixedly supported by the stay 25. This can prevent deformation of the nip forming member 24 due to pressure by the pressing roller 22, so as to obtain a uniform nip width over the axial direction of the pressing roller 22. It is to be noted that preferably the stay 25 is formed of a metal material with high mechanical strength, such as stainless steel or iron, in order to prevent distortion of the nip forming member 24. Further, the base pad 241 is desirably formed of a material with certain hardness for ensuring the strength. As a material for the base pad 241, a resin such as a liquid crystal polymer (LCP), metal, ceramic, or the like can be used.

Further, the base pad 241 is formed of a heat resistant member with a heat resistant temperature of not lower than 200° C. This prevents deformation of the nip forming member 24 due to heat in a toner fixing temperature range, thereby reliably maintaining a desirable condition of the nip portion N and hence stabilizing quality of an output image. For the base pad 241, a general heat resistant resin such as polyether sulfone (PES), polyphenylene sulfide (PPS), liquid crystal polymer (LCP), polyether nitrile (PEN), polyamide imide (PAI), or polyether ether ketone (PEEK) may be used.

The sliding sheet 240 may at least be disposed on the surface of the base pad 241 which is opposite to the fixing belt 21. With this configuration, when the fixing belt 21 rotates, the fixing belt 21 slides with respect to this low friction sheet, thereby reducing a driving toque that is generated in the fixing belt 21 and hence reducing a load on the fixing belt 21 by frictional force. Alternatively, a configuration without the sliding sheet may also be applicable.

The reflective member 26 is disposed between the stay 25, and the halogen heaters 23A and 23B. Examples of a material for the reflective member 26 include, but are not limited to aluminum and stainless. As the reflective member 26 is disposed in such a manner, light emitted from the halogen heaters 23A and 23B towards the stay 25 is reflected onto the fixing belt 21. This can increase an amount of light that illuminates the fixing belt 21, thereby heating efficiently the fixing belt 21. Further, since it is possible to suppress transmission of radiation heat from the halogen heaters 23A and 23B to the stay 25 and so forth, energy can be saved.

According to the present illustrative embodiment, for the sake of further energy saving and improvement in first print output time, the fixing unit 20 employs a direct heating method in which the fixing belt 21 is directly heated by the halogen heaters 23A and 23B at a place other than the nip portion N. In the present illustrative embodiment, nothing is placed between the halogen heaters 23A and 23B and the left-side portion of the fixing belt 21 of FIG. 2, thereby heating directly the fixing belt 21 with radiation heat from the halogen heaters 23A and 23B.

Further, in order to achieve a low heat capacity, the fixing belt 21 is made thin and has a small diameter. More specifically, respective thicknesses of the base member, the elastic layer and the separating layer constituting the fixing belt 21 are configured to be in a range of from 20 μm to 50 μm, 100 μm to 300 μm, and 10 μm to 50 μm, respectively, and a thickness as a whole is equal to or less than 1 mm. Further, the diameter of the fixing belt 21 is in a range of from 20 mm to 40 mm. Further, in order to obtain a low heat capacity, a total thickness of the fixing belt 21 is preferably equal to or less than 0.2 mm, and more preferably, equal to or less than 0.16 mm. Moreover, preferably, a diameter of the fixing belt 21 is equal to or less than 30 mm.

It is to be noted that in the present illustrative embodiment, the diameter of the pressing roller 22 is in a range of from 20 to 40 mm, and the diameter of the fixing belt 21 and the diameter of the pressing roller 22 are configured to be the same. However, the configuration of the fixing belt 21 and the pressing roller 22 is not limited to this. For example, the diameter of the fixing belt 21 may be smaller than the diameter of the pressing roller 22. In that case, a curvature of the fixing belt 21 in the nip portion N becomes smaller than a curvature of the pressing roller 22, thereby separating the paper P being output from the nip portion N easily from the fixing belt 21.

Further, as a result of making the diameter of the fixing belt 21 small as described above, a space inside the fixing belt 21 becomes small, but in the present illustrative embodiment, the stay 25 is formed in a concave shape with both end sides bent, and the halogen heaters 23A and 23B are housed inside that portion formed in the concave shape, thereby allowing the stay 25 and the halogen heaters 23A and 23B to be disposed even inside the small space.

Moreover, in order to make the stay 25 as large as possible within the given small space, the nip forming member 24 is on the contrary formed to be compact. More specifically, the width of the base pad 241 in the paper delivery direction is narrower than the width of the stay 25 in the paper delivery direction. Further, in FIG. 2, when heights of an upstream end 24*a* of the base pad 241 and a downstream end 24*b* of the base pad 241 in the paper delivery direction with respect to the nip portion N (or its virtual extended line E) are referred to as h1 and h2, and when the maximum height of the portion of the base pad 241 other than the upstream end 24*a* and the downstream end 24*b* with respect to the nip portion N (or its virtual extended line E) is referred to as h3, the following relation is satisfied: $h1 \leq h3$, $h2 \leq h3$.

With this configuration, the upstream end 24*a* and the downstream end 24*b* of the base pad 241 are not located between the fixing belt 21 and the respective bent portions of the stay 25 on the upstream side and the downstream side in the paper delivery direction, and hence the respective bent portions can be brought close to the inner peripheral surface of the fixing belt 21. This allows the stay 25 to take up as much area as possible inside the limited space inside the fixing belt 21, thereby ensuring the strength of the stay 25. Consequently, it is possible to prevent distortion of the nip forming member 24 due to the pressing roller 22, thereby enhancing fixing properties.

Further, in order to ensure the strength of the stay 25, in the present illustrative embodiment, the stay 25 has a base portion 25*a* which is in contact with the nip forming member 24 and extends in the paper delivery direction (vertical direction of FIG. 2), and rising portions 25*b* which extend from the respective ends on the upstream side and the downstream side of the base portion 25*a* in the paper delivery direction toward a contact direction of the pressing roller 22 (left side of FIG. 2). That is, with the rising portion 25*b* provided in the stay 25, the stay 25 has a horizontally long cross section extending in the pressing direction of the pressing roller 22, thereby increasing the section modulus and hence enhancing the mechanical strength of the stay 25.

Further, forming the rising portion 25*b* longer in the contact direction of the pressing roller 22 enhances the strength of the stay 25. Therefore, the tip of the rising portion 25*b* is desirably as close to the inner peripheral surface of the fixing belt 21 as possible. However, since a vibration (disturbance of behavior) occurs in some degree in the fixing belt 21 during its rotation, when the tip of the rising portion 25*b* is brought excessively close to the inner peripheral surface of the fixing belt 21, the fixing belt 21 might come into contact with the tip of the rising portion 25*b*. Especially when the fixing belt 21 is thin as in the present illustrative embodiment, a degree of vibration of the fixing belt 21 is large, and hence the position of the tip of the rising portion 25*b* needs to be determined carefully.

More specifically, according to the present illustrative embodiment, a distance d between the tip of the rising portion 25*b* and the inner peripheral surface of the fixing belt 21 in the contact direction of the pressing roller 22 is preferably at least 2.0 mm, and more preferably equal to or greater than 3.0 mm.

By contrast, when the fixing belt 21 has a certain thickness and hardly vibrates, the distance d can be set to 0.02 mm.

As described above, disposing the tip of the rising portion 25*b* as close to the inner peripheral surface of the fixing belt 21 as possible allows the rising portion 25*b* to be long in the contact direction of the pressing roller 22. With this configuration, the mechanical strength of the stay 25 can be enhanced even if the fixing belt 21 has a small diameter.

As illustrated in FIGS. 4A and 4B, a belt holder 40 is inserted into the end of the fixing belt 21, and rotatably holds the end of the fixing belt 21. Although only the configuration of one-side end is illustrated in the drawings, the other end is configured in a similar manner.

As illustrated in FIG. 4C, the belt holder 40 is formed in a sidewardly open C-shaped, with an opening facing the nip portion (position where the nip forming member 24 is disposed). Further, the end of the stay 25 is fixed to this belt holder 40 and positioned in place.

Moreover, as illustrated in FIG. 4A or 4B, a slip ring 41 as a protective member for protecting the end of the fixing belt 21 is provided between the end surface of the fixing belt 21 and the opposite surface of the belt holder 40 which is opposed thereto. Therefore, when the balance of the fixing belt 21 is shifted in the axial direction, it is possible to prevent the end of the fixing belt 21 from coming into direct contact with the belt holder 40, so as to prevent friction or damage of the end. Further, the slip ring 41 is fitted to the belt holder 40 with some allowance between the slip ring 41 and the outer periphery of the belt holder 40. For this reason, when the end of the fixing belt 21 comes into contact with the slip ring 41, the slip ring 41 is rotatable along with the fixing belt 21, but the slip ring 41 may stand still without rotating along therewith. As a material for the slip ring 41, it is preferable to employ so-called super engineering plastic excellent in heat resistance, such as PEEK, PPS, PAI or PTFE.

It should be noted that a shielding member for shielding heat from the halogen heaters 23A and 23B is disposed between the fixing belt 21 and the halogen heaters 23A and 23B at both ends of the fixing belt 21 in the axial direction. This can suppress an excessive temperature rise in a no-paper passing region of the fixing belt 21 during continuous passing of paper, hence preventing degradation and damage of the fixing belt.

Hereinafter, with reference to FIG. 2, a basic operation of the fixing device according to the present illustrative embodiment will be described. When the power of the main body is turned on, power is applied to the halogen heaters 23A and 23B, while the pressing roller 22 starts to rotate in the clockwise direction in FIG. 2. Thereby, the fixing belt 21 is rotated counterclockwise in FIG. 2 due to frictional force with the pressing roller 22.

Subsequently, by the above-described image formation process, the paper P bearing an unfixed toner image T is delivered in a direction of an arrow A1 of FIG. 2 while being guided by a guide plate 37 and sent into the nip portion N between the fixing belt 21 and the pressing roller 22 in a pressure-contact state. Then, the toner image T is fixed to the surface of the paper P by the heat applied by the fixing belt 21 heated by the halogen heaters 23A and 23B and pressuring force between the fixing belt 21 and the pressing roller 22.

The paper P on which the toner image T is fixed is carried out of the nip portion N in a direction of an arrow A2 in FIG. 2. At this time, the tip of the paper P comes into contact with the tip of the separation member 28, thereby separating the paper P from the fixing belt 21. Thereafter, the separated paper P is output to the outside of the apparatus by a sheet output roller and stacked in the output paper tray as described above.

Figure 5:
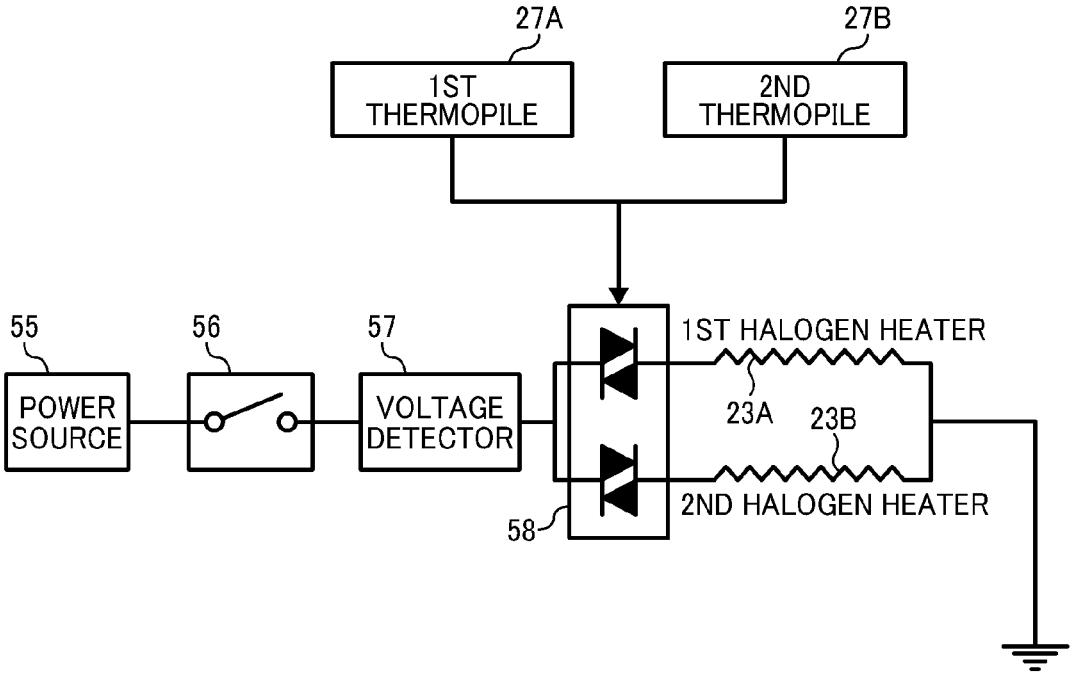
FIG. 5 is a block diagram of a control system of the fixing device.

FIG. 5 is a block diagram of a control system of the fixing device 20 according to the illustrative embodiment of the present invention. Electric power supplied from a power source unit 55 is supplied to the first halogen heater 23A and the second halogen heater 23B via a relay 56, a voltage detector (voltage detecting mechanism) 57 and a triac 58. The triac 58 controls power supply (turn-on ratio) of the halogen heaters 23A and 23B based on temperatures detected by the thermopiles 27A and 27B, to keep the fixing belt 21 at a predetermined temperature. The relay 56 is in an on state at the time of start-up operation upon turning on the power supply of the image forming apparatus, at the time of passing paper, and the like. Only after the relay 56 is turned on and the triac 58 is also turned on, electric power is applied from the power source unit 55 to the halogen heaters 23A and 23B. By contrast, upon turning-off of the power source of the image forming apparatus, in a standby state, at the time of occurrence of abnormality, or the like, the relay 56 is turned off, and the electric power supply to the halogen heaters 23A and 23B is shut off.

It is to be noted that the "standby state" herein refers to a state in which, after turning on the power source of the image forming apparatus and after the lapse of predetermined time without using the apparatus, part of electric power supply is stopped or reduced and a return command is waited, and also includes a state called an energy-saving mode on which power saving is sought. Furthermore, "return" means being supplied with electric power required for image formation from the power source and coming into a printable state. Moreover, examples of the "energy-saving mode" include: a "low electric power mode" in which, when a certain time lapses after the last use of the apparatus, an electric power supply is stopped and the fixing temperature is decreased except for part of an engine-system load; a "sleep mode" in which, when an operation is continuously not performed after shifting to the low electric power mode, application of electric power to an engine-system load is stopped; and an "off mode" in which, when the apparatus is not used for the set time or longer, application of electric power to all of the engine-system loads and controller systems except for part thereof is stopped.

The voltage detector 57 detects an applied voltage to the halogen heaters 23A and 23B at the time of start-up operation upon turning on the power supply and at the time of return from the standby state. As a result of this voltage detection by the voltage detector 57, the maximum turn-on ratios of the halogen heaters 23A and 23B are adjusted. For example, in the case of a high voltage, the maximum turn-on ratios of the halogen heaters 23A and 23B are set low.

Hereinafter, a voltage detecting method as a characteristic part of the present invention will be described.

In the present illustrative embodiment, voltage detection is performed in a state where the halogen heater is turned on for one to two seconds with a duty cycle of 100% in order to detect an accurate voltage. However, when using the thin fixing belt 21 as in the present illustrative embodiment, when both of the two halogen heaters 23A and 23B are turned on for one to two seconds with a duty cycle of 100%, if by chance a voltage higher than the rated voltage is applied to the halogen heater, the temperature of the fixing belt 21 may rise excessively, causing degradation and damage of the fixing belt 21.

For this reason, in the case of detecting the voltage, a voltage is applied only to one of the halogen heaters so as to prevent the temperature of the fixing belt 21 from rising excessively. In the present illustrative embodiment, one of the two halogen heaters 23A and 23B, that is, the first halogen heater 23A having the heat generating portion at the midsection is turned on for one to two seconds with a duty cycle of 100%, and a voltage at that time is detected.

Alternatively, it is possible to supply electric power to the second halogen heater 23B in a similar manner in place of the first halogen heater 23A, and detect a voltage. However, since the second halogen heater 23B is a heater less frequently used than the first halogen heater 23A, it is preferable to perform voltage detection on the first halogen heater 23A. Further, turning on the halogen heater for one to two seconds which is performed for voltage detection also serves as heating the fixing belt 21 to a predetermined temperature, but the output of the second halogen heater 23B is lower than that of the first halogen heater 23A. For this reason, when the second halogen heater 23B is turned on for voltage detection, an amount of heat supplied to the fixing belt 21 is less and as a result, the temperature-rise time of the fixing belt 21 takes long as compared with the case of the halogen heater 23A being turned on. For this reason, also in terms of shortening the temperature-rise time, preferably, the first halogen heater 23A is turned on for voltage detection.

As described above, the temperature of the fixing belt 21 is prevented from rising excessively by turning on only one of the halogen heaters to detect a voltage. However, in this case, an amount of heat supplied to the fixing belt 21 is small and hence the temperature-rise time of the fixing belt 21 takes long as compared with the case of turning on both of the halogen heaters. Therefore, in the present illustrative embodiment, in order to prevent extension of the temperature-rise time, hence reducing extension of waiting time of the users, voltage detection is performed as described below.

Figure 6:
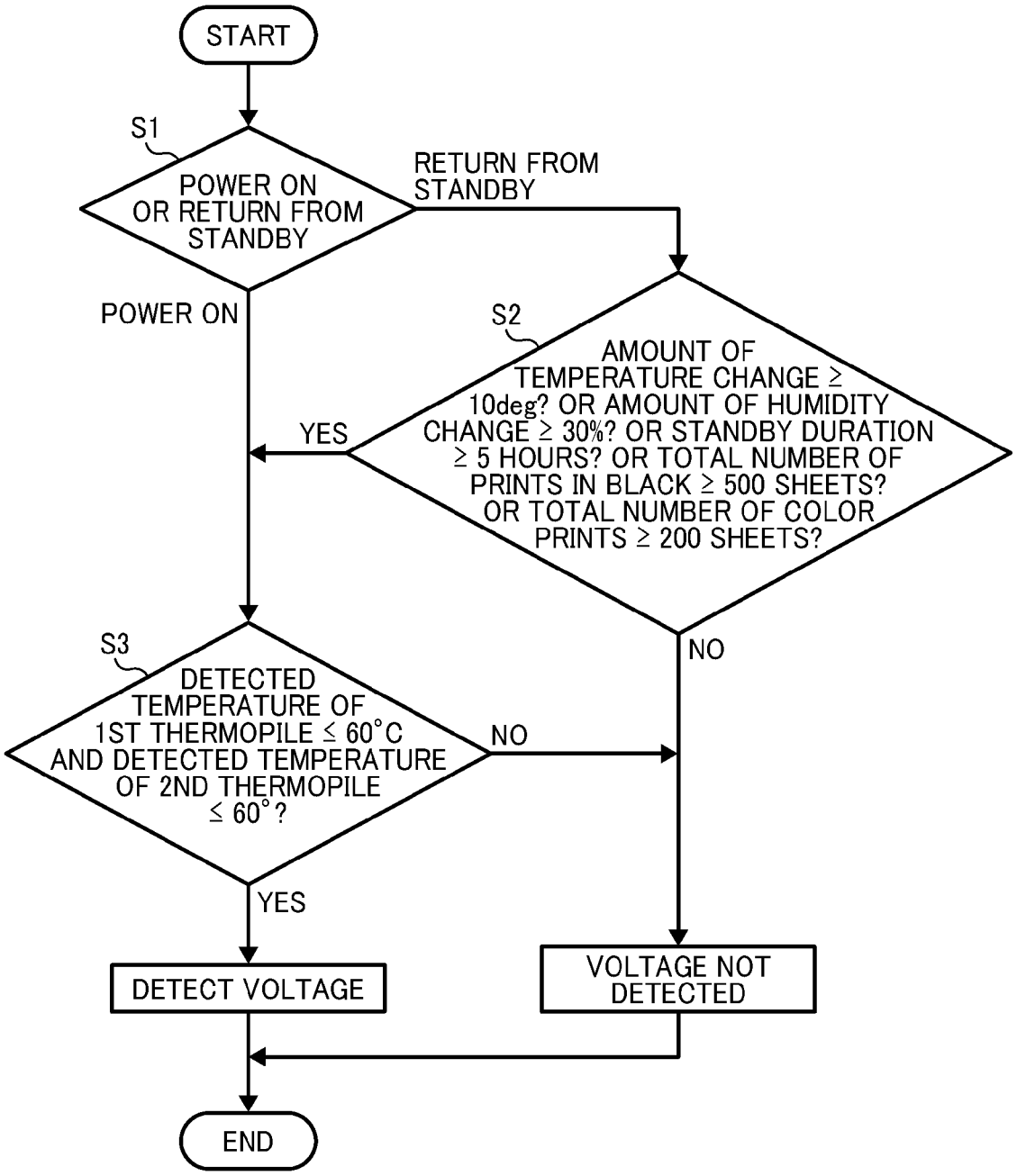
FIG. 6 is a view illustrating a flowchart of a voltage detection method.

With reference to FIG. 6, a voltage detecting method according to the present illustrative embodiment will be described. FIG. 6 is a flowchart showing example steps of the voltage detection.

Although the voltage detection of the halogen heater is performed at the time of start-up operation upon turning on the image forming apparatus or at the time of return from the standby state, at step S1, first, in the image forming apparatus, it is checked whether the power source is turned on or the apparatus returns from the standby state.

When the power source of the image forming apparatus is turned on, it is necessary to start up the controller. In the present illustrative embodiment, starting up the controller takes 20 seconds, while the time required for normal temperature rise of the fixing belt is not longer than 10 sec. That is, even when the voltage detection is performed and the temperature-rise time of the fixing belt is extended, a series of operations from the start of the voltage detection to completion of the temperature rise of the fixing belt can be performed within the start-up operation time of the controller. For this reason, when the power source of the image forming apparatus is turned on, the voltage detection is performed at the time of start-up.

By contrast, upon returning from the standby state, the controller has already been started up, and basically a time margin at the time of return from the standby state is short as compared with the time of the start-up operation upon turning on the power source. However, when an image formation adjustment (also know as process control) is performed at the time of return, since the operation takes approximately 15 seconds, the time margin during which voltage detection is performed can be held. According to the present illustrative embodiment, the image formation adjustment includes an operation of detecting a potential of a photoreceptor and a toner concentration, for example, and adjusting process conditions such as a charging grid of the photoreceptor and a development bias based on the detection results.

In the present illustrative embodiment, immediately after the start of the return operation, at step S2, it is determined by the control unit in the image forming apparatus whether or not any of conditions 1 to 5 below applies, and when any of them is determined to apply, the image formation adjustment is performed.

1. A case where, at the time of return, a degree of fluctuation of an ambient operating temperature (i.e., temperature inside the image forming apparatus) from the start of the standby state until the return is equal to or greater than 10 deg.

2. A case where, at the time of return, a degree of fluctuation of an ambient operating humidity (i.e., humidity inside the image forming apparatus) from the start of the standby state until the return is equal to or greater than 30%.

3. A case where, at the time of return, the standby time from the start of the standby state until the return is five hours or more.

4. A case where the cumulative count of black-printed sheets after the previous image formation adjustment is 500 or more.

5. A case where the cumulative count of color-printed sheets after a previous image formation adjustment is 200 or more.

It is to be noted that each of the conditions and numeric values shown in 1 to 5 are one example, and are not limited thereto. Further, the image forming apparatus include a temperature detector, a humidity detector, standby-time measuring mechanism (timer) and the printed-sheet-count storing mechanism (counter).

When it is determined that any of the above conditions applies and the image formation adjustment is to be performed, the voltage detection is performed during the image formation adjustment. By contrast, when the image formation adjustment is not to be performed, the voltage detection is not performed because there is no time margin.

As described above, in the present illustrative embodiment, although the voltage detection is performed when there is the time margin, that is, when the image formation adjustment is performed at the time of start-up upon turning on the image forming apparatus or at the time of return from the standby state, even in these cases, when the temperature of the fixing belt or the pressing roller is high before the start of a power supply to the halogen heater, the voltage detection is not performed. This is because, if the temperature of the fixing belt or the pressing roller is initially high, when the voltage detection is performed, the halogen heater, though only a part thereof, is turned on with a duty cycle of 100%, and hence the temperature of the fixing belt may rise excessively. For this reason, in the present illustrative embodiment, it is verified at step S3 whether both detection temperatures of the first thermopile and the second thermopile are less than or equal to 60° C. in the control unit of the image forming apparatus before activation of the voltage detection, and the voltage detection is performed only when the detection temperatures are not higher than 60° C. By contrast, when at least one of the detection temperatures of the first thermopile and the second thermopile exceeds 60° C., the voltage detection is not performed.

As described above, according to the present illustrative embodiment of the present invention, by turning on only one of the plurality of halogen heaters for predetermined time (for example, one to two seconds) with a duty cycle of 100%, an accurate voltage can be detected without an excessive temperature rise of the fixing belt even when a voltage higher than a rated voltage is applied to the halogen heater. This can prevent degradation and damage of the fixing belt, while accurately performing management of the fixing temperature based on an accurate voltage detection result.

Further, although turning on only one of the halogen heaters causes longer temperature-rise time of the fixing belt, the voltage detection is performed only when there is the time margin in the above embodiment, whereby it is possible to avoid or alleviate extension of the waiting time due to the longer temperature-rise time. This allows the voltage detection to be performed without impairing the usability. Further, according to the illustrative embodiment, the voltage detection is not performed even when there is the time margin when the temperature of the fixing belt is initially high, thereby to reliably prevent an excessive temperature rise of the fixing belt.

Figure 7:
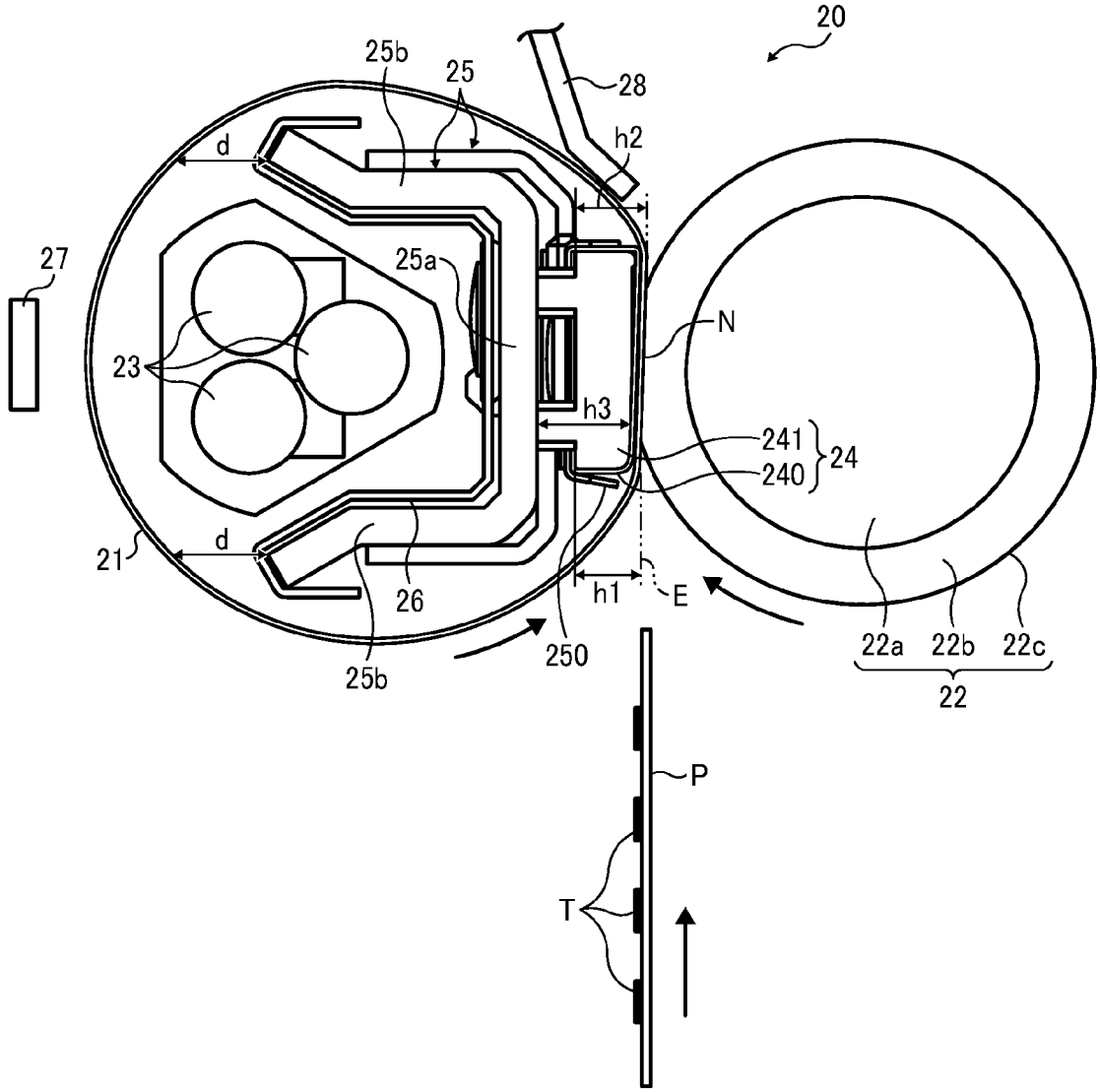
FIG. 7 is a schematic diagram illustrating a fixing device including three halogen heaters.

Although the embodiment of the present invention has been described above, the present invention is not limited to the foregoing embodiments, but a variety of modifications can naturally be made within the scope of the present invention. For example, as illustrated in FIG. 7, the present invention is applicable to a fixing device provided with three or more halogen heaters 23. In this case, the number of halogen heaters 23 which are turned on at the time of voltage detection may be one as in the foregoing embodiment, or two (plural). It is to be noted that in FIG. 7 a metal sheet 250 is provided to surround the nip forming member 24, and in this case, the nip forming member 24 is supported by the stay 25 via the metal sheet 250. Configurations other than the above are basically similar to the configurations of the embodiment illustrated in FIG. 2 above.

Figure 8:
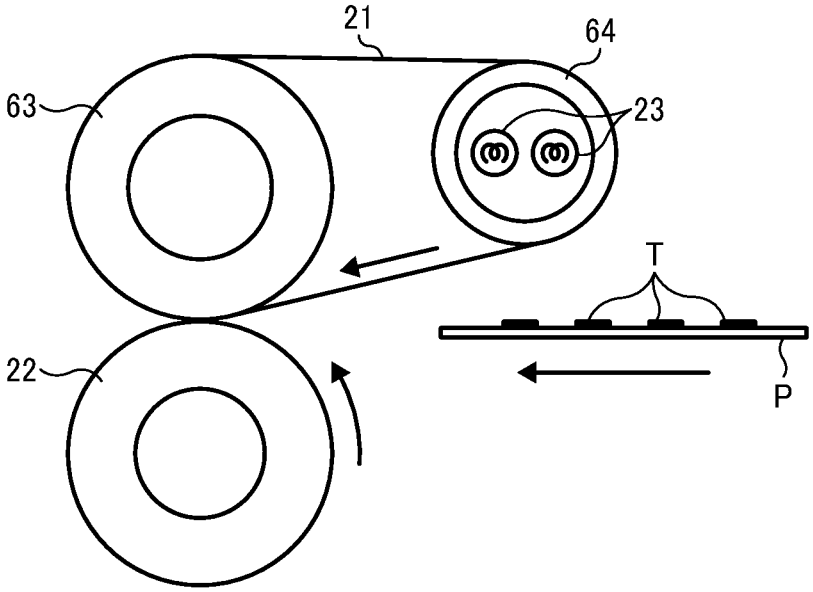
FIG. 8 is a schematic diagram illustrating a fixing device in which the fixing belt is stretched by a fixing roller and a heating roller.
Figure 9:
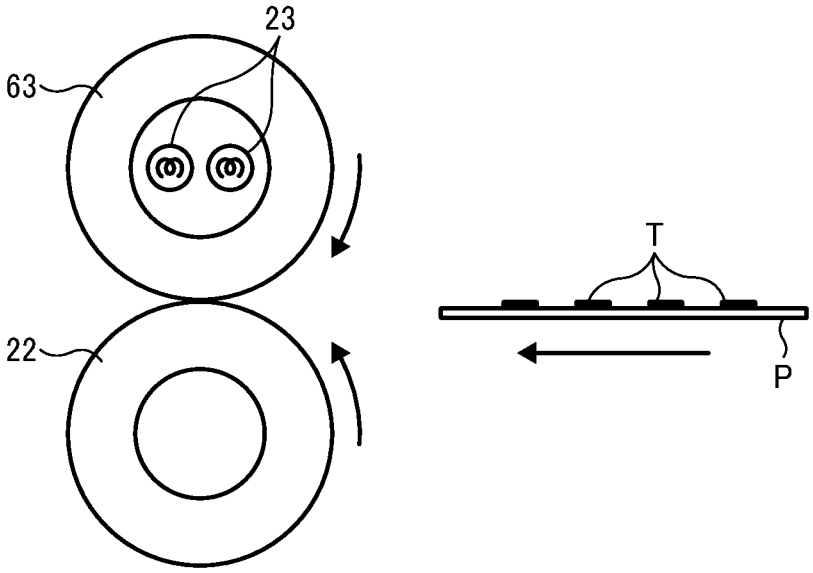
FIG. 9 is a schematic diagram illustrating the fixing device using the fixing roller in place of the fixing belt.

Moreover, the present invention is also applicable to a fixing device in which the fixing belt 21 is entrained about a fixing roller 63 and a heating roller 64 including the halogen heater 23 inside thereof as illustrated in FIG. 8. The present invention is also applicable to a fixing device in which the fixing roller 63 including the halogen heater 23 inside thereof is used in place of the fixing belt 21 as illustrated in FIG. 9, or to some other device. Also in these fixing devices, turning on only a portion of the halogen heater 23 allows accurate voltage detection while preventing an excessive temperature rise of the fixing belt 21, the fixing roller 63, and so forth. It is especially effective when the heating roller 64 and the fixing roller 63 are thin and thus the temperatures thereof tend to rise.

Moreover, the fixing device according to the present invention is not restrictively mounted in the color laser printer illustrated in FIG. 1, but can also be mounted in a monochrome image forming apparatus.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device, comprising:

a fixing member;

an opposing member disposed opposite the fixing member, the opposing member configured to contact the fixing member to form a nip portion at which an unfixed image on a recording medium is fixed;

a plurality of heat sources configured to heat the fixing member based on at least one voltage applied from a power source;

a controller configured to enable at least one less than all of the plurality of heat sources at a 100% duty cycle during a voltage detection operation while disabling a rest of the plurality of heat sources; and a voltage detector configured to detect the at least one applied voltage of the enabled heat sources during the voltage detection operation, wherein upon detection of the at least one applied voltage of the enabled heat source by the voltage detector, the controller is configured to adjust the at least one voltage applied to the plurality of heat sources.

2. The fixing device according to claim 1, wherein upon image formation adjustment at the time of return from a standby state, the controller is configured to perform the voltage detection operation.

3. The fixing device according to claim 2, further comprising:

an environment detector configured to detect an operating temperature, wherein the image formation adjustment is performed when, at the time of return from the standby state, the operating temperature at the time of return from the standby state is different from the operating temperature at the start of standby state and the difference is equal to or greater than a threshold value.

4. The fixing device according to claim 2, further comprising:

an environment detector configured to detect an operating humidity, wherein the image formation adjustment is performed when, at the time of return from the standby state, the operating humidity at the time of return from the standby state is different from the operating humidity at the start of standby state and the difference is equal to or greater than a threshold value.

5. The fixing device according to claim 2, wherein the image formation adjustment is performed when, at the time of return from the standby state, a standby time from the start of the standby state until the return is equal to or longer than a threshold time.

6. The fixing device according to claim 2, wherein the image formation adjustment is performed when a cumulative count of printed sheets after a previous image formation adjustment is equal to or greater than a threshold count.

7. The fixing device according to claim 1, wherein when a power source of an image forming apparatus is turned on, the voltage detection operation is performed at the time of startup of the image forming apparatus.

8. The fixing device according to claim 1, wherein the voltage detection operation is performed when the temperature of one of the fixing member and the opposing member before turning on the heat sources is equal to or lower than a threshold value.

9. The fixing device according to claim 1, wherein the fixing member is an endless-shaped fixing belt.

10. An image forming apparatus, comprising the fixing device of claim 1.

11. The fining device according to claim 1, wherein the controller is configured to, determine if the controller is initializing, and perform the voltage detection operation only if the controller is initializing.

12. The fixing device according to claim 1, wherein the controller is configured to enable the plurality of heat sources by controlling bidirectional triode thyristors (TRIACs) connected thereto.

13. The fixing device according to claim 1, wherein during a normal operation different from the voltage detection operation, the duty cycle of the plurality of heat sources is less than 100%.

14. The fixing device according to claim 1, wherein the enabled heat source is one of two heat sources included in the plurality of heat sources.

15. A fixing device, comprising:

a fixing member;

an opposing member disposed opposite the fixing member, the opposing member configured to contact the fixing member to form a nip portion at which an unfixed image on a recording medium is fixed;

a plurality of heat sources configured to heat the fixing member based on at least one voltage applied from a power source;

a controller configured to, determine if the controller is initializing, and perform a voltage detection operation only if the controller is initializing, the voltage detection operation enabling at least one less than all of the plurality of heat sources at a 100% duty cycle while disabling a rest of the plurality of heat sources; and a voltage detector configured to detect the at least one applied voltage of the enabled heat sources during the voltage detection operation, wherein upon detection of the at least one applied voltage of the enabled heat source by the voltage detector, the controller is configured to adjust the at least one voltage applied to the plurality of heat sources, and the controller is configured to perform the voltage detection operation only if a temperature of the fixing member is below a threshold when the controller is initializing.

* * * * *